US009242461B1

(12) United States Patent
Reinten et al.

(10) Patent No.: US 9,242,461 B1
(45) Date of Patent: Jan. 26, 2016

(54) DROPLET GENERATING DEVICE

(71) Applicant: OCE-TECHNOLOGIES B.V., Venlo (NL)

(72) Inventors: Hans Reinten, Venlo (NL); Maikel A. J. Huygens, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/829,916

(22) Filed: Aug. 19, 2015

(30) Foreign Application Priority Data

Aug. 20, 2014 (EP) ..... 14181499

(51) Int. Cl.
*B41J 2/045* (2006.01)
*B41J 2/14* (2006.01)

(52) U.S. Cl.
CPC ..... *B41J 2/14201* (2013.01); *B41J 2/14233* (2013.01)

(58) Field of Classification Search
CPC ..... B41J 2/14201; B41J 2/14233; B41J 2/14274; B41J 2/14282; B41J 2002/14467; B41J 2/161
See application file for complete search history.

(56) References Cited

U.S. PATENT DOCUMENTS 4,364,066 A * 12/1982 Koto ..... B41J 2/14233 347/70
5,530,465 A 6/1996 Hasegawa et al.
2002/0171715 A1 11/2002 Takahagi et al.
2010/0182388 A1 7/2010 Yang et al.
2011/0102516 A1 5/2011 Mardilovich et al.

FOREIGN PATENT DOCUMENTS

JP 2013-994 A 1/2013
WO WO 2006/066102 A1 6/2006

* cited by examiner

*Primary Examiner* — Geoffrey Mruk
(74) *Attorney, Agent, or Firm* — Birch, Stewart, Kolasch & Birch, LLP

(57) ABSTRACT

A droplet generating device includes a wafer with a recess that defines a pressure chamber, a flexible membrane bonded to the wafer so as to cover the recess and form a wall of the pressure chamber, and an actuator attached to the membrane for flexing the membrane to generate a pressure wave in a liquid in the pressure chamber, the pressure chamber having a first port connected to a liquid supply line, and a second port connecting the pressure chamber to a nozzle, at least one of the ports being arranged adjacent to the membrane, wherein the wafer forms at least one island portion that projects into the at least one of the ports, engages the membrane and divides the port into at least two separate passages, and wherein the at least one island portion is arranged to delimit a flexing part of the membrane on a side of the at least one of the ports.

10 Claims, 2 Drawing Sheets

DROPLET GENERATING DEVICE

The invention relates to a droplet generating device comprising a wafer with a recess that defines a pressure chamber, a flexible membrane bonded to the wafer so as to cover the recess and form a wall of the pressure chamber, and an actuator attached to the membrane for flexing the same to generate a pressure wave in a liquid in the pressure chamber, the pressure chamber having a first port connected to a liquid supply line, and a second port connecting the pressure chamber to a nozzle, at least one of the ports being arranged adjacent to the membrane, wherein the wafer forms at least one island portion that projects into at least one of the ports, engages the membrane and divides the port into at least two separate passages.

Droplet generating devices of this type are used for example for generating ink droplets in an ink jet printer. In an ink jet print head, many of these devices are integrated in a MEMS (Micro-Electro-Mechanical System). The actuator may for example be a piezoelectric actuator attached to a side of the membrane opposite to the pressure chamber. When the actuator is activated, it causes the membrane to flex so that a pressure wave is generated in the liquid in the pressure chamber, and this pressure wave propagates towards the nozzle where an ink droplet is expelled.

In a typical device of this type, the membrane is clamped on three adjacent sides of the pressure chamber between the wafer and a solid support member that defines a cavity opposite to the pressure chamber, e.g. for accommodating the actuator. On the fourth side of the pressure chamber, the recess in the wafer is open to form the port that connects the pressure chamber to the nozzle, and the membrane is supported here only on the support member.

Typically, the pressure chamber and, correspondingly, the flexing part of the membrane have an elongated rectangular shape, with the nozzle-side port of the pressure chamber being arranged on one of the smaller sides of the rectangle. When the actuator is energized, the membrane flexes two-dimensionally, and the bending compliance of the membrane depends critically upon the distance between the opposite edges of the flexing part, where the membrane is supported by the wafer and/or the support member.

WO 2006/066102 A1 and JP 2013 000 994 A disclose devices according to the preamble of claim 1, wherein the membrane is formed by a plate having a thin, flexing part that is delimited by thicker parts of the plate.

US 2011/102516 A1 discloses a device having twin actuators associated with different flexible parts of the membrane. The pressure chamber is divided by island portions which separate the flexible parts in the direction transverse to the direction from the first port to the second port.

U.S. Pat. No. 5,530,465 A discloses a device wherein the part of the pressure chamber that forms the nozzle-side port is constituted by a narrowed and tapered end portion of the pressure chamber.

It is an object of the invention to provide a droplet generating device of the type indicated above which can be manufactured more easily and in which the drop forming behaviour is reproducible with high accuracy.

In order to achieve this object, said at least one island portion is arranged to delimit a flexing part of the membrane on a side of said at least one of the ports.

The island portion supports the flexible membrane on the side forming one of the ports. As a consequence, the membrane may be formed by a plate with uniform thickness, and the compliance and flexing behaviour of the membrane is determined by structures that are formed on one and the same member, i.e. the wafer. This permits to produce the structures that delimit the flexing part of the membrane on all four sides with high positional accuracy, e.g. by utilizing photolithographic techniques for forming the recess and the island portion in the wafer. As a consequence, the flexing behaviour of the membrane and hence the drop forming behaviour of the device are hardly influenced by any other factors such as the alignment accuracy with which the wafer and the support member on the opposite side of the membrane are bonded to the membrane, thus avoiding the risk that the flexing properties of the membrane are affected by any alignment errors.

Although the island does not support the membrane on the entire length of the corresponding side of the pressure chamber, it has the effect the distance between the parts that support the membrane is reduced by at least a factor of two. Since the flexing compliance of the membrane is proportional to the fifth power of that distance, the island portion practically prevents any flexing deformation of the membrane and therefore effectively delimits the flexing part of the membrane.

More specific optional features of the invention are indicated in the dependent claims.

The island portion may be formed either in the port that is connected to the liquid supply line or in the exit port that is connected to the nozzle. The part of the pressure chamber that forms this port has preferably an increased width so as to compensate for the loss in cross-sectional area that will be caused by the presence of the island portion. As a result, the cross-sectional area of the port may be at least the same as in conventional devices, so that an increase of the fluidic impedance, which is also a critical factor for the drop forming behaviour, is avoided.

The nozzle may be formed either in the wafer that defines also the pressure chamber or in the support member that is bonded to the opposite side of the membrane. In the latter case, the membrane has a feedthrough that connects the exit port of the pressure chamber to the nozzle.

The actuator may be a thin-film bimorph piezoelectric actuator and may be arranged opposite to one of the ports, the island portion being arranged in the other one of the ports.

An embodiment example will now be described in conjunction with the drawings, wherein.

Figure 1:
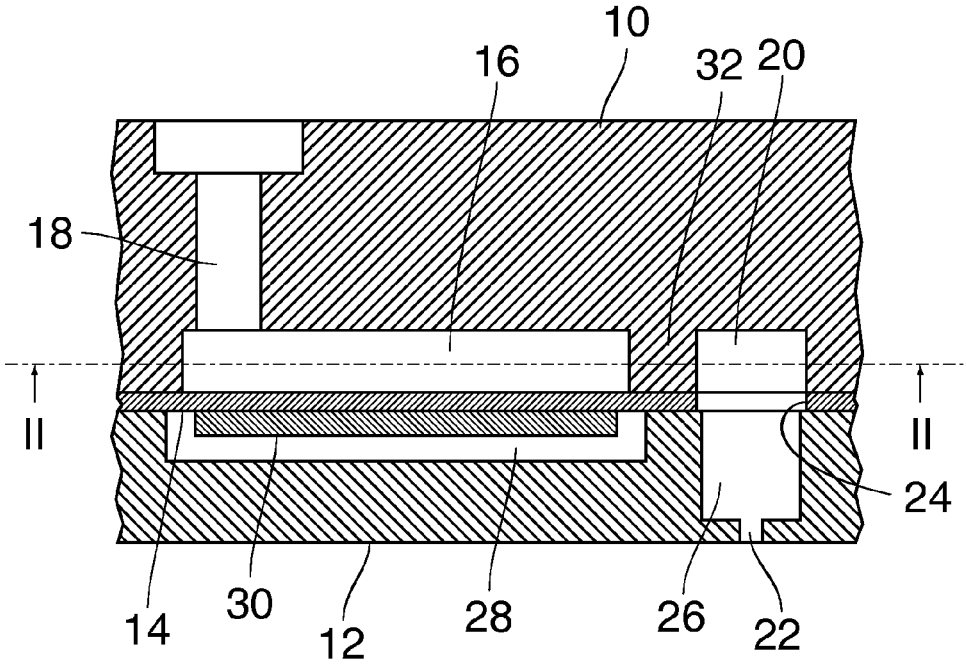
FIG. 1 is a sectional view of a droplet generating device according to the invention.

As is shown in FIG. 1, a droplet generating device that may for example form part of an ink jet print head comprises a wafer 10 and a support member 12 that are bonded to opposite sides of a thin flexible membrane 14.

Figure 2:
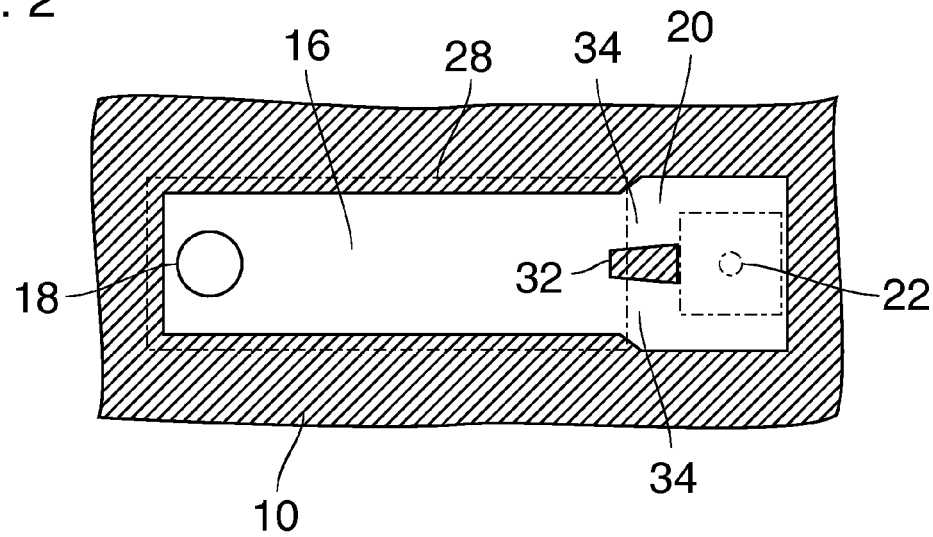
FIG. 2 is a sectional view taken along the line II-II in FIG. 1.

A recess that forms a pressure chamber 16 is formed in the face of the wafer 10 that engages the membrane 14, i.e. the bottom face in FIG. 1. The pressure chamber 16 has an essentially rectangular shape, as can be seen in FIG. 2, and an end portion on the left side in FIGS. 1 and 2 forms a first port that is connected to a liquid supply line 18 that passes through the wafer 10 in thickness direction of the wafer and serves for supplying liquid ink to the pressure chamber 16.

At the opposite end, the pressure chamber 16 has a widened end portion serving as a second port 20 connecting the pressure chamber 16 to a nozzle 22 that is formed in the support member 12. Fluid communication between the port 20 and the nozzle 22 is established by a feedthrough 24 in the membrane 14 and a cavity 26 in the support member 12.

Adjacent to the membrane 14 and separated from the cavity 26, the support member 12 forms another cavity 28 accommodating a piezoelectric actuator 30 that is attached to the membrane 14.

In a position opposite to a dam that separates the cavities 26 and 28 of the support member 12, the wafer 10 forms an island portion 32 that projects into the port 20 and has an end surface held in engagement with and bonded to the top surface of the membrane 14. As can be seen in FIG. 2, the island portion 32 thus divides the port 20 into two separate passages 34.

The liquid supply line 18 and the pressure chamber 16 including the second port 20 and the island 32 are formed in the wafer 10 by means of photolithographic techniques, which permits a high positional accuracy for the walls delimiting the pressure chamber 16 and the island portion 32. On three sides of the pressure chamber 16 and also partly on the fourth side where the island portion 32 is positioned, the membrane 14 is clamped between the wafer 10 and the support member 12. Thus, only a portion of the membrane 14 that separates the pressure chamber 16 from the cavity 28 is allowed to flex upwardly and/or downwardly under the action of the actuator 30.

When seen in the direction normal to the plane of the membrane 14, the cavity 28 in the support member 12 has a rectangular shape that has been indicated in dot-dashed lines in FIG. 2. In width-wise direction and in lengthwise direction towards the left side in FIG. 2 (the side of the first port), the cavity 28 extends beyond the boundaries of the pressure chamber 16, so that the exact limits of the flexing part of the membrane are defined by the edges of the recess in the wafer 10 that forms the pressure chamber 16. On the side of the second port 20, the cavity 28 overlaps with the island portion 32.

Figure 3:
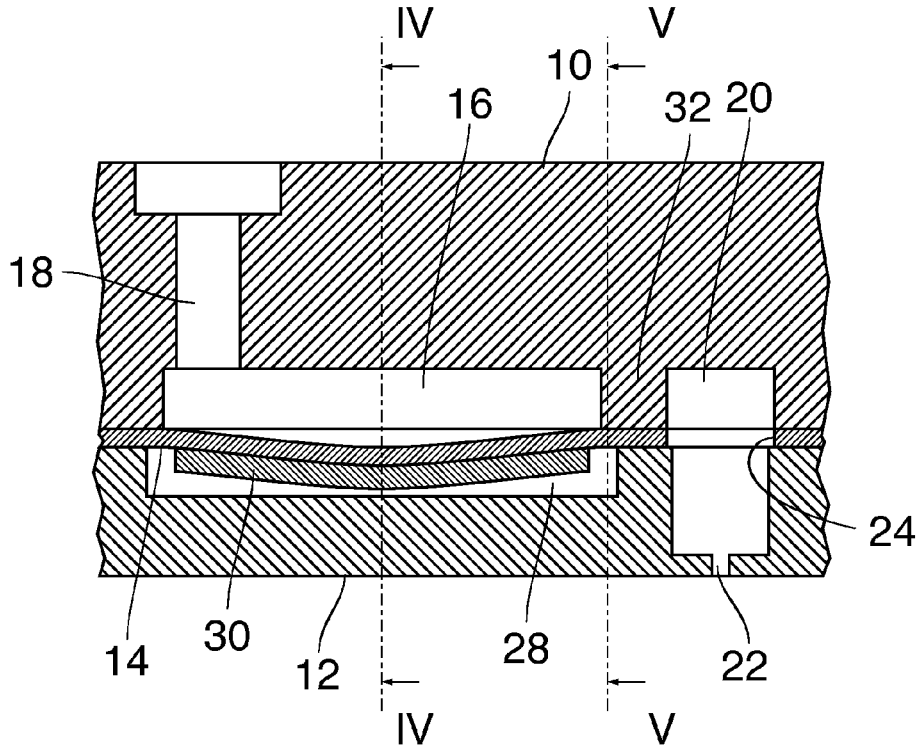
FIG. 3 is a sectional view corresponding to FIG. 1 but showing the device in an active state in which a membrane is flexed.
Figure 4:
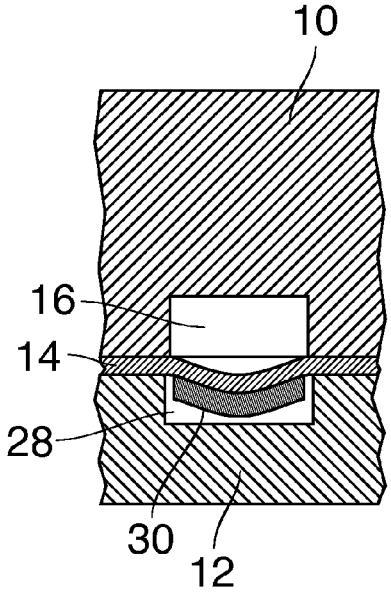
FIG. 4 is a cross-sectional view taken along the line IV-IV in FIG. 3.

When the actuator 30 is energized, the flexing part of the membrane 14 is caused to flex upwardly or downwardly, as has been illustrated in FIGS. 3 and 4. In a downward stroke (shown in FIGS. 3 and 4), a volume ink is sucked into the pressure chamber 16 via the supply line 18. Then, in a subsequent upward stroke of the actuator 30, the membrane flexes upwardly into the pressure chamber 16, so that the ink contained therein is compressed, and an acoustic pressure wave propagates through the two passages 34 of the exit port 20 towards the nozzle 22, so that an ink droplet is expelled from the nozzle.

As the width of the port 20 increases at the very point where the island portion 32 begins, the cross-sectional area of the port 20 is essentially the same as that of the rest of the pressure chamber 16, so that the fluidic inductivity of the pressure generating and drop forming system is not increased. Further, the island portion 32 may have a streamlined contour or may be tapered towards the centre of the pressure chamber 16 as in the example shown here.

Figure 5:
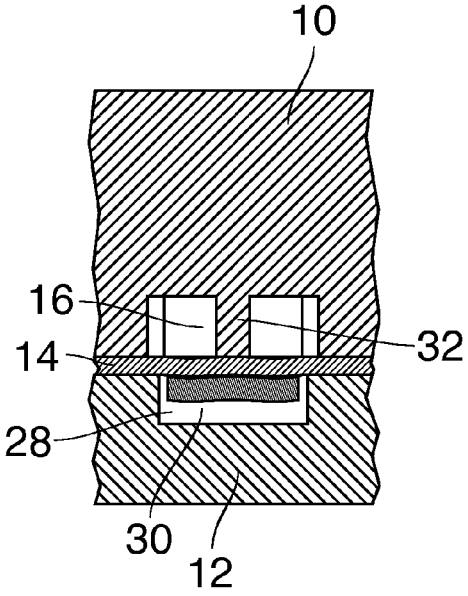
FIG. 5 is a cross-sectional view taken along the line V-V in FIG. 3.

Since the end face of the island portion 32 is bonded to the membrane 14, the island portion 32 prevents any substantial flexing deformation of the membrane 14 at the position shown in FIG. 5. Consequently, the flexing part of the membrane 14 is effectively delimited on the side of the port 20 by the end of the island portion 32 that faces the centre of the pressure chamber 16. Thus, the deformation behaviour of the membrane 14 is determined by the positions of the side walls of the pressure chamber 16 and the position of the end of the island portion 32. In contrast, the position of the support member 12 and the cavity 28 formed therein has no critical effect on the deformation behaviour of the membrane. As a consequence, when any alignment error should occur when the wafer 10, the membrane 14 and the support member 12 are bonded together, this error will not compromise the drop forming behaviour of the device.

The invention claimed is:

1. A droplet generating device comprising:

a wafer with a recess that defines a pressure chamber;

a flexible membrane bonded to the wafer so as to cover the recess and form a wall of the pressure chamber; and an actuator attached to the membrane for flexing the membrane to generate a pressure wave in a liquid in the pressure chamber, the pressure chamber having a first port connected to a liquid supply line, and a second port connecting the pressure chamber to a nozzle, at least one of the ports being arranged adjacent to the membrane, wherein the wafer forms at least one island portion that projects into at least one of the ports, engages the membrane and divides the port into at least two separate passages, and wherein said at least one island portion is arranged to delimit a flexing part of the membrane on a side of said at least one of the ports.

2. The device according to claim 1, wherein the pressure chamber has a rectangular shape when seen in a direction normal to a plane of the membrane, and said port into which the island portion projects is arranged at one end of the pressure chamber.

3. The device according to claim 2, wherein said at least one island portion projects into the second port.

4. The device according to claim 3, wherein the island portion is tapered towards the pressure chamber.

5. The device according to claim 1, wherein the second port has a width that is larger than a width of the rest of the pressure chamber.

6. The device according to claim 5, wherein the width of the second port corresponds to the width of the rest of the pressure chamber plus a width of the island portion.

7. The device according to claim 1, wherein the membrane is clamped between said wafer and a support member that is bonded to the opposite side of the membrane and has a cavity, the side walls of the cavity being outwardly offset relative to the side walls of the pressure chamber and relative to the end of the island portion, respectively, that faces inwardly of the pressure chamber.

8. The device according to claim 7, wherein the nozzle is formed in the support member and communicates with the second port of the pressure chamber via a feedthrough in the membrane.

9. The device according to claim 1, wherein the actuator is a thin film-bimorph piezoelectric actuator and is arranged opposite to one of the ports, the island portion being arranged in the other one of the ports.

10. The device according to claim 1, wherein the membrane is formed by a plate with uniform thickness.

* * * * *